US007439217B2

(12) United States Patent
Boutique et al.

(10) Patent No.: US 7,439,217 B2
(45) Date of Patent: Oct. 21, 2008

(54) LIQUID LAUNDRY DETERGENT COMPRISING A CATIONIC SILICONE POLYMER AND A COACERVATE PHASE FORMING CATIONIC POLYMER

(75) Inventors: Jean-Pol Boutique, Gembloux (BE); Patrick Firmin August Delplancke, Laarne (BE); Roland Wagner, Bonn (DE); Matthew David Butts, Rexford, NY (US); Sarah Elizabeth Genovese, Delmar, NY (US); Stefano Scialla, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/818,650

(22) Filed: Jun. 15, 2007

(65) Prior Publication Data

US 2008/0171684 A1 Jul. 17, 2008

Related U.S. Application Data

(63) Continuation of application No. 10/700,810, filed on Nov. 4, 2003, now Pat. No. 7,273,837.

(60) Provisional application No. 60/445,796, filed on Feb. 7, 2003, provisional application No. 60/423,482, filed on Nov. 4, 2002.

(51) Int. Cl.
*C11D 1/62* (2006.01)
*C11D 9/36* (2006.01)

(52) U.S. Cl. ..... 510/287; 510/276; 510/300; 510/305; 510/320; 510/327; 510/329; 510/374; 510/392; 510/394; 510/466; 510/504

(58) Field of Classification Search ..... 510/287, 510/276, 300, 305, 320, 322, 327, 329, 374, 510/392, 394, 466, 504
See application file for complete search history.

(56) References Cited

U.S. PATENT DOCUMENTS

| | | | | |
|---|---|---|---|---|
| 4,364,837 | A | 12/1982 | Pader | |
| 4,371,517 | A * | 2/1983 | Vanlerberghe et al. | 424/70.13 |
| 4,597,962 | A * | 7/1986 | Grollier et al. | 424/47 |
| 4,661,267 | A | 4/1987 | Dekker et al. | |
| 4,818,242 | A | 4/1989 | Burmeister et al. | |
| 4,960,845 | A | 10/1990 | O'Lenick, Jr. et al. | |
| 5,080,312 | A | 1/1992 | Ebey | |
| 5,085,857 | A * | 2/1992 | Reid et al. | 424/70.12 |
| 5,276,979 | A | 1/1994 | Gordon, Sr. | |
| 5,296,625 | A | 3/1994 | O'Lenick, Jr. et al. | |
| 5,302,322 | A * | 4/1994 | Birtwistle | 510/121 |
| 5,500,152 | A * | 3/1996 | Helliwell | 510/403 |
| 5,580,494 | A * | 12/1996 | Sandhu et al. | 510/125 |
| 5,656,257 | A * | 8/1997 | Fealy et al. | 424/70.13 |
| 5,747,435 | A * | 5/1998 | Patel | 510/119 |
| 5,792,737 | A * | 8/1998 | Gruning et al. | 510/126 |
| 6,028,041 | A * | 2/2000 | Decoster et al. | 510/119 |
| 6,134,810 | A | 10/2000 | Stockley | |
| 6,136,215 | A | 10/2000 | Evans et al. | |
| 6,277,361 | B1 * | 8/2001 | Murray | 424/70.12 |
| 6,355,234 | B1 * | 3/2002 | Birtwistle et al. | 424/70.27 |
| 6,391,835 | B1 * | 5/2002 | Gott et al. | 510/143 |
| 6,451,747 | B1 * | 9/2002 | Decoster | 510/119 |
| 6,545,085 | B2 * | 4/2003 | Kilgour et al. | 524/588 |
| 6,551,970 | B2 * | 4/2003 | Decoster et al. | 510/122 |
| 6,562,772 | B1 * | 5/2003 | Maurin et al. | 510/124 |
| 6,638,527 | B2 * | 10/2003 | Gott et al. | 424/443 |
| 6,730,621 | B2 * | 5/2004 | Gott et al. | 442/123 |
| 6,743,760 | B1 * | 6/2004 | Hardy et al. | 510/125 |
| 6,790,819 | B2 * | 9/2004 | Trinh et al. | 510/287 |
| 6,808,701 | B2 * | 10/2004 | Duden et al. | 424/70.19 |
| 6,827,795 | B1 * | 12/2004 | Kasturi et al. | 134/42 |
| 6,833,344 | B2 | 12/2004 | Boutique et al. | |
| 6,858,202 | B2 * | 2/2005 | Niemiec et al. | 424/70.12 |
| 6,903,061 | B2 | 6/2005 | Masschelein et al. | |
| 7,205,270 | B2 | 4/2007 | Delplancke et al. | |
| 7,273,837 | B2 | 9/2007 | Boutique et al. | |
| 2002/0068689 | A1 | 6/2002 | Fender et al. | |
| 2002/0103094 | A1 | 8/2002 | Masschelein et al. | |
| 2005/0164900 | A1 | 7/2005 | Masschelein et al. | |

FOREIGN PATENT DOCUMENTS

| | | |
|---|---|---|
| CA | 2320500 | 3/2001 |
| EP | 0 422 787 | 4/1991 |
| EP | 0 468 721 A | 1/1992 |
| EP | 0 530 974 A | 3/1993 |
| EP | 0 811 051 B1 | 12/1997 |
| EP | 0 989 226 | 3/1999 |
| EP | 0 971 025 A | 1/2000 |
| EP | 1 058 530 B1 | 12/2000 |
| FR | 2 353 633 A | 10/1980 |
| JP | 10211390 | 8/1998 |
| WO | WO 99/44567 | 9/1999 |

(Continued)

*Primary Examiner*—Charles I Boyer
(74) *Attorney, Agent, or Firm*—Armina E. Matthews; Kim William Zerby; Steven W. Miller

(57) ABSTRACT

The invention is directed to a liquid laundry detergent composition comprising at least one detergent ingredient selected from the group consisting of anionic surfactant, zwitterionic surfactant, amphoteric surfactant, and mixtures thereof; a coacervate phase forming cationic polymer; and one or more fabric care ingredients selected from the group consisting of one or more cationic silicone polymers comprising one or more polysiloxane units and one or more nitrogen moieties; one or more amino silicone polymers; one or more nitrogen-free silicone polymers; and mixtures thereof; and a liquid carrier for providing cleaning and fabric care benefits. A process for preparing such compositions, a method for treating substrates, a method for providing certain fabric care benefits and the use of such compositions are also described.

16 Claims, No Drawings

FOREIGN PATENT DOCUMENTS

| | | | |
|---|---|---|---|
| WO | WO 00/24853 | | 5/2000 |
| WO | WO 00/24857 | | 5/2000 |
| WO | WO 00/70005 | A1 | 11/2000 |
| WO | WO 00/71806 | A1 | 11/2000 |
| WO | WO 01/25386 | A1 | 4/2001 |
| WO | WO 01/25387 | A1 | 4/2001 |
| WO | WO 02/10259 | A1 | 2/2002 |
| WO | WO 02/18528 | | 3/2002 |
| WO | WO 02/36095 | A2 | 5/2002 |
| WO | WO 03/101411 | A1 | 12/2003 |

* cited by examiner

LIQUID LAUNDRY DETERGENT COMPRISING A CATIONIC SILICONE POLYMER AND A COACERVATE PHASE FORMING CATIONIC POLYMER

CROSS REFERENCE TO RELATED APPLICATIONS

This application is a continuation of U.S. application Ser. No. 10/700,810, filed Nov. 4, 2003 now U.S. Pat. No. 7,273,837, which claims the benefit of U.S. Provisional Application Ser. No. 60/445,796, filed on Feb. 7, 2003 and U.S. Provisional Application Ser. No. 60/423,482, filed on Nov. 4, 2002.

FIELD OF THE INVENTION

This invention relates to liquid laundry detergent compositions. The invention also relates to methods for treating fabrics in fabric treatment applications including domestic laundering to thereby provide improved cleaning and fabric care. The invention further relates to processes for preparing such liquid laundry detergent compositions.

BACKGROUND OF THE INVENTION

When consumers launder fabrics, they desire not only excellence in cleaning, they also seek to impart superior fabric care benefits. Such care can be exemplified by one or more of reduction of wrinkles benefits; removal of wrinkles benefits; prevention of wrinkles benefits; fabric softness benefits; fabric feel benefits; garment shape retention benefits; garment shape recovery benefits; elasticity benefits; ease of ironing benefits; perfume benefits; color care benefits; anti-abrasion benefits; anti-pilling benefits; or any combination thereof. Compositions which provide both cleaning and fabric care benefits, e.g., fabric softening benefits, are known as "2 in 1" detergent compositions and/or as "softening-through-the-wash"-compositions.

In laundering, there exist unique and significant challenges for securing fabric care. EP 422 787 (Dow Corning Corp., published Apr. 17, 1991) describes liquid fabric softening laundering compositions comprising a silicone fabric softening agent which is a specific polyorganosiloxane free of reactive organic functional groups and/or a polysiloxane gum having a specific formula. The compositions deliver improved softening benefits and deliver cleaning benefits are the same time. WO 00/70 005 A1 (Unilever, published Nov. 23, 2000) describes fabric softening compositions comprising a nonionic fabric softening agent, an anionic surfactant and a cationic polymer for the purpose of improving the deposition of the softening agent onto the fabric.

In spite of the advances in the art, there remains a need for compositions providing improved cleaning and fabric care benefits in a single application. In particular, there remain important unsolved problems with respect to selecting compatible fabric care and fabric cleaning ingredients so that the combination of both provides uncompromising levels of fabric care. Furthermore, it remains particularly difficult to combine anionic surfactants and cationic fabric care beneficial agents in such a way as to secure superior fabric care at the same time as outstanding cleaning and formulation stability or flexibility.

Accordingly, objects of the present invention include to solve the hereinabove mentioned technical problems and to provide compositions and methods having selected surfactants and specifically selected cationic fabric care agents and optionally other adjuncts that secure superior fabric cleaning and superior fabric care.

One embodiment of the present invention is a liquid laundry detergent composition comprising at least one detergent ingredient, a coacervate phase forming cationic polymer and one or more fabric care ingredients. The combination of these ingredients provides superior fabric cleaning and superior fabric care benefits.

Moreover the invention has other advantages, depending on the precise embodiment, which include superior formulation flexibility and/or formulation stability of the home laundry compositions provided.

It has surprisingly been found that, given proper attention to the selection of the fabric care ingredient, unexpectedly good fabric care and/or consumer acceptance of the home laundry product are obtained. Moreover, superior fabric care or garment care benefits in home laundering as discovered in the present invention unexpectedly include benefits when the products herein are used in different modes, such as treatment before washing in an automatic washing machine, through-the wash benefits, and post-treatment benefits, including benefits secured when the inventive products are used in the rinse or in fabric or garment spin-out or drying in, or outside an appliance. Additionally discovered are regimen benefits, i.e., benefits of converting from use of a product system comprising conventional detergents to a product system comprising use of the present inventive compositions and compositions formulated specifically for use therewith. In particular, it has been found that the combination of a surfactant, a cationic polymer and one or more fabric care ingredients provides synergistic effects for fabric cleaning and fabric care. This is particularly true for fabric softening benefits, for anti-abrasion benefits, and for anti-pilling benefits or any combination thereof, imparted to fabrics which have been treated with the liquid laundry detergent compositions of the present invention.

SUMMARY OF THE INVENTION

The present invention relates to a liquid laundry detergent composition comprising at least one detergent ingredient selected from the group consisting of anionic surfactant, zwitterionic surfactant, amphoteric surfactant and mixtures thereof; a coacervate phase forming cationic polymer; and one or more fabric care ingredients selected from the group consisting of one or more cationic silicone polymers comprising one or more polysiloxane units and one or more nitrogen moieties, one or more amino silicone polymers, one or more nitrogen-free silicone polymers, and mixtures thereof; and a liquid carrier.

The present invention also relates to a liquid laundry detergent composition comprising at least one detergent ingredient selected from the group consisting of anionic surfactant, zwitterionic surfactant, amphoteric surfactant and mixtures thereof; a coacervate phase forming cationic polymer; and one or more cationic silicone polymers comprising one or more polysiloxane units and one or more nitrogen moieties, and optionally one or more fabric care ingredients selected from the group consisting of one or more amino silicone polymers, one or more nitrogen-free silicone polymers, and mixtures thereof; and a liquid carrier.

The invention further includes the use of the liquid laundry detergent composition of the present invention to impart fabric cleaning benefits and fabric care benefits on a fabric substrate.

The invention also describes a process for preparing a liquid laundry detergent composition comprising a set of steps of:

A: a) premixing the coacervate phase forming cationic polymer with the fabric care ingredient, wherein the coacervate phase forming cationic polymer is optionally present as an aqueous solution and wherein the fabric care ingredient is optionally present as an emulsion in water; b) premixing all other ingredients; and c) combining said two premixes a) and b); or, B: a) preparing a premix comprising all other ingredients except the coacervate phase forming cationic polymer and except the fabric care ingredient; b) combining the premix from step a) with the coacervate phase forming polymer, which is optionally present in form of an aqueous solution; and c) combining the fabric care ingredient which is optionally present as an emulsion in water with the mixture of step b).

The present invention further describes a method for treating a substrate. This method includes contacting the substrate with the liquid laundry detergent composition of the present invention such that the substrate is treated.

The present invention also includes methods for providing fabric softening benefits, anti-abrasion benefits, anti-pilling benefits or any combination thereof to fabrics which have been treated with the liquid laundry detergent compositions of the present invention. Indeed, it has been found that these benefits are even more enhanced when compositions of the present invention are imparted to colored fabrics than to white fabrics. It is believed that the enhanced performance on colored fabrics over white fabrics is driven by enhanced deposition of the fabric care ingredient on colored fabrics than on white fabrics. Without being bound by theory, it is believed that this higher deposition rates results from an interaction between the fabric care ingredient and the dye molecules of the garment.

It has been further found that the performance of certain highly preferred amino silicone polymers in terms of providing fabric softening benefits, anti-abrasion benefits, anti-pilling benefits or any combination thereof is superior even over the performance of nitrogen-free silicone polymers.

DETAILED DESCRIPTION OF THE INVENTION

A, Surfactants—The present compositions comprise as one essential component at least one surfactant selected from the group consisting of anionic surfactant, zwitterionic surfactant, amphoteric surfactant and mixtures thereof. Suitable levels of this component are in the range from 1.0% to 80%, preferably from 5.0% to 65%, more preferably from 10% to 50% by weight of the composition.

(a1) Anionic Surfactants—The compositions of the invention comprise an anionic surfactant. By nature, every anionic surfactant known in the art of detergent compositions may be used, such as disclosed in "Surfactant Science Series", Vol. 7, edited by W. M. Linfield, Marcel Dekker. However, the compositions of the present invention comprise preferably at least a sulphonic acid surfactant, such as a linear alkyl benzene sulphonic acid, but water-soluble salt forms may also be used. Anionic surfactant(s) are typically present at a level of from 1.0% to 70%, preferably from 5.0% to 50% by weight, and more preferably from 10% to 30% by weight of the fabric treatment composition.

Anionic sulfonate or sulfonic acid surfactants suitable for use herein include the acid and salt forms of C5-C20, more preferably C10-C16, more preferably C11-C13 alkylbenzene sulfonates, C5-C20 alkyl ester sulfonates, C6-C22 primary or secondary alkane sulfonates, C5-C20 sulfonated polycarboxylic acids, and any mixtures thereof, but preferably C11-C13 alkylbenzene sulfonates.

Anionic sulphate salts or acids surfactants suitable for use in the compositions of the invention include the primary and secondary alkyl sulphates, having a linear or branched alkyl or alkenyl moiety having from 9 to 22 carbon atoms or more preferably 12 to 18 carbon atoms.

Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the C5-C22, preferably C10-C20 mid-chain branched alkyl primary sulphates. When mixtures are used, a suitable average total number of carbon atoms for the alkyl moieties is preferably within the range of from greater than 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl ethyoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium. Preferably, the anionic surfactants are neutralized with alkanolamines such as Mono Ethanol Amine or Triethanolamine, and are fully soluble in the liquid phase.

(a2) Amphoteric and Zwitterionic Surfactants: Suitable amphoteric or zwitterionic detersive surfactants for use in the composition herein include those which are known for use in hair care or other personal care cleansing. Concentration of such amphoteric detersive surfactants preferably ranges from 0.0% to 20%, preferably from 0.5% to 5%. Non-limiting examples of suitable zwitterionic or amphoteric surfactants are described in U.S. Pat. Nos. 5,104,646 (Bolich Jr. et al.), 5,106,609 (Bolich Jr. et al.).

Amphoteric detersive surfactants suitable for use in the composition are well known in the art, and include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Suitable amphoteric detersive surfactants for use in the present invention include cocoamphoacetate, cocoamphodiacetate, lauroamphoacetate, lauroamphodiacetate, and mixtures thereof.

Zwitterionic detersive surfactants suitable for use in the compositions are well known in the art, and include those surfactants broadly described as derivatives of aliphatic quaternary ammonium, phosphonium, and sulfonium compounds, in which the aliphatic radicals can be straight or branched chain, and wherein one of the aliphatic substituents contains from 8 to 18 carbon atoms and one contains an anionic group such as carboxy, sulfonate, sulfate, phosphate or phosphonate. Zwitterionics such as betaines are suitable for this invention.

Furthermore, amine oxide surfactants having the formula: $R(EO)_x(PO)_y(BO)_zN(O)(CH_2R')_2.qH_2O$ (I) are also suitable for incorporation within the compositions of the present invention. R is a relatively long-chain hydrocarbyl moiety which can be saturated or unsaturated, linear or branched, and can contain from 8 to 20, preferably from 10 to 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Non-limiting examples of other anionic, zwitterionic, amphoteric or optional additional surfactants suitable for use in the compositions are described in McCutcheon's, Emulsifiers and Detergents, 1989 Annual, published by M. C. Publishing Co., and U.S. Pat. Nos. 3,929,678, 2,658,072; 2,438,091; 2,528,378.

B, Coacervate Phase forming Cationic Polymer—Suitable levels of this component are in the range from 0.01% to 10%, preferably from 0.02% to 3%, more preferably from 0.03% to 1.5%, and most preferably from 0.05% to 0.2% by weight of the composition. The coacervate phase forming cationic polymer may be a homopolymer or be formed from two or more types of monomers. The monomer weight of the polymer will generally be between 5 000 and 10 000 000, typically at least 10 000 and preferably in the range 100 000 to 2 000 000. Preferred coacervate phase forming cationic polymers will have cationic charge densities of at least 0.2 meq/gm, preferably at least 0.25 meq/gm, more preferably at least 0.3 meq/gm, but also preferably less than 5 meq/gm, more preferably less than 3 meq/gm, and most preferably less than 2 meq/gm at the pH of intended use of the composition, which pH will generally range from pH 3 to pH 9, preferably between pH 4 and pH 8. The coacervate phase forming cationic polymer is of natural or synthetic origin and selected from the group consisting of substituted and unsubstituted polyquaternary ammonium compounds, cationically modified polysaccharides, cationically modified (meth)acrylamide polymers/copolymers, cationically modified (meth) acrylate polymers/copolymers, chitosan, quaternized vinylimidazole polymers/copolymers, dimethyldiallylammonium polymers/copolymers, polyethylene imine based polymers, cationic guar gums, and derivatives thereof and mixtures thereof, preferably cationic guar hydroxypropyltriammonium salts and derivatives thereof, more preferably said cationic guar hydroxypropyltriammonium salts are halide salts or methylsulfate salts, even more preferably said cationic guar hydroxypropyltriammonium salts are chloride salts.

The polymers will have cationic nitrogen containing groups such as quaternary ammonium or protonated amino groups, or a mixture thereof. The cationic nitrogen-containing group will generally be present as a substituent on a fraction of the total monomer units of the cationic polymer. Thus, when the polymer is not a homopolymer it can contain spacer non-cationic monomer units. Such polymers are described in the CTFA Cosmetic Ingredient Directory, $7^{th}$ edition. The ratio of the cationic to non-cationic monomer units is selected to give a polymer having a cationic charge density in the required range. Any anionic counterions can be used in association with the cationic polymers so long as the polymers in the coacervate phase of the composition, and so long as the counterions are physically and chemically compatible with the essential components of the composition or do not otherwise unduly impair product performance, stability or aesthetics. Non-limiting examples of such counterions include halides (e.g., chloride, fluoride, bromide, iodide), sulfate and methylsulfate.

Non-limiting examples of suitable coacervate phase forming cationic polymers include copolymers of vinyl monomers having cationic protonated amine or quaternary ammonium functionalities with water soluble spacer monomers such as acrylamide, methacrylamide, alkyl and dialkyl acrylamides, alkyl and dialkyl methacrylamides, alkyl acrylate, alkyl methacrylate, vinyl caprolactone and vinyl pyrrolidine. The alkyl and dialkyl substituted monomers preferably have C1-C7 alkyl groups, more preferably C1-C3 alkyl groups. Other suitable spacers include vinyl esters, vinyl alcohol, maleic anhydride, propylene glycol and ethylene glycol.

The cationic amine can be primary, secondary or tertiary amines, depending upon the particular species and the pH of the composition. In general secondary and tertiary amines, especially tertiary, are preferred.

Amine substituted vinyl monomers and amines can be polymerized in the amine form and then converted to ammonium by quaternization.

The coacervate phase forming cationic polymers can comprise mixtures of monomer units derived from amine- and/or quaternary ammonium-substituted monomer and/or compatible spacer monomers.

Other coacervate phase forming cationic polymers suitable for the use in the compositions of the present invention include, for example: a) copolymers of 1-vinyl-2-pyrrolidine and 1-vinyl-3-methyl-imidazolium salt (e.g. chloride alt), referred to in the industry by the Cosmetic, Toiletry, and Fragrance Association, (CTFA) as Polyquaternium-16. This material is commercially available from BASF Wyandotte Corp. under the LUVIQUAT tradename (e.g. LUVIQUAT FC 370); b) copolymers of 1-vinyl-2-pyrrolidine and dimethylaminoethyl methacrylate, referred to in the industry (CTFA) as Polyquaternium-11. This material is available commercially from Graf Corporation (Wayne, N.J., USA) under the GAFQUAT tradename (e.g. GAFQUAT 755N); c) cationic diallyl quaternary ammonium-containing polymers including, for example, dimethyldiallylammonium chloride homopolymer and copolymers of acrylamide and dimethyldiallylammonium chloride, referred to in the industry (CTFA) as Polyquatemium 6 and Polyquatemium 7, respectively; d) mineral acid salts of amino-alkyl esters of homo- and copolymers of unsaturated carboxylic acids having from 3 to 5 carbon atoms as describes in U.S. Pat. No. 4,009,256; e) amphoteric copolymers of acrylic acid including copolymers of acrylic acid and dimethyldiallylammonium chloride (referred to in the industry by CTFA as Polyquatemium 22), terpolymers of acrylic acid with dimethyldiallylammonium chloride and acrylamide (referred to in the industry by CTFA as Polyquaternium 39), and terpolymers of acrylic acid with methacrylamidopropyl trimethylammonium chloride and methylacrylate (referred to in the industry by CTFA as Polyquaternium 47). Preferred cationic substituted monomers are the cationic substituted dialkylaminoalkyl acrylamides, dialkylaminoalkyl methacrylamides, and combinations thereof. These preferred monomers conform to the formula:

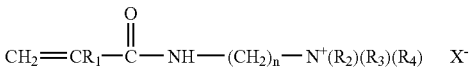

wherein $R^1$ is hydrogen, methyl or ethyl; each of $R^2$, $R^3$ and $R^4$ are independently hydrogen or a short chain alkyl having from 1 to 8 carbon atoms, preferably from 1 to 5 carbon atoms, more preferably from 1 to 2 carbon atoms; n is an integer having a value of from 1 to 8, preferably from 1 to 4; and X is a counterion as described in hereinbefore. The nitrogen attached to $R^2$, $R^3$ and $R^4$ may be a protonated amine (primary, secondary or tertiary), but is preferably a quaternary ammonium wherein each of $R^2$, $R^3$ and $R^4$ are alkyl groups a non limiting example of which is polymethyacrylamidopropyl trimonium chloride, available under the trade name Polycare 133, from Rhone-Poulenc, Cranberry, N.J., U.S.A. Also preferred are copolymers of this cationic monomer with nonionic monomers such that the cationic charge density of the copolymer remains in the range specified above.

Other coacervate phase forming cationic polymers suitable in the compositions of the present invention include cationic polysaccharide polymers, such as cationic cellulose and derivatives thereof, cationic starch and derivatives thereof, and cationic guar gums and derivatives thereof.

Cationic polysaccharide polymers suitable for use in the compositions of the present invention include those of the formula:

$$A—O—[R—N^+(R^1)(R^2)(R^3)]X^-$$

wherein A is an anhydroglucose residual group, such as a starch or cellulose anhydroglucose residual, R is an alkylene, oxyalkylene, polyoxyalkylene, or hydroxyalkylene group, or combination thereof; and $R^1$, $R^2$, and $R^3$ independently represent alkyl, aryl, alkylaryl, arylalkyl, alkoxyalkyl, or alkoxyaryl, each group comprising up to 18 carbon atoms. The total number of carbon atoms for each cationic moiety (i.e. the sum of carbon atoms in $R^1$, $R^2$, and $R^3$) is preferably 20 or less, and X is an anionic counterion as described hereinbefore.

Cationic cellulose is available from Amerchol Corp. (Edison, N.J., USA) in their Polymer JR (trade mark) and LR (trademark) series of polymers, as salts of hydroxyethyl cellulose reacted with trimethyl ammonium substituted epoxide, referred to in the industries (CTFA) as Polyquaternium 10. Another suitable type of cationic cellulose includes the polymeric quaternary ammonium salts of hydroxyethyl cellulose reacted with lauryl dimethyl ammonium-substituted epoxide, referred to in the industry as (CTFA) as Polyquaternium 24. These materials are available from Amerchol Corp. under the tradename Polymer LM-200.

Other suitable cationic polysaccharide polymers include quaternary nitrogen-containing cellulose ethers as described in U.S. Pat. No. 3,962,418 and copolymers of etherified cellulose and starch as described in U.S. Pat. No. 3,958,581.

A particular suitable type of cationic polysaccharide polymer that can be used is a cationic guar gum derivative, such as the cationic polygalactomannan gum derivatives described in U.S. Pat. No. 4,298,494, which are commercially available from Rhone-Poulenc in their JAGUAR tradename series. An example of a suitable material is hydroxypropyltrimonium chloride of the formula:

$$G—O—CH_2—\underset{\underset{OH}{|}}{CH}—CH_2—N^+—(CH_3)_3 \quad X^-$$

where G represents guar gum, and X is an anionic counterion as described hereinbefore, preferably chloride. Such a material is available under the tradename of JAGUAR C-13-S. In JAGUAR C-13-S the cationic charge density is 0.7 meq/gm. Similar cationic guar gums are also available from AQUALON under the tradename of N-Hance® 3196 and Galactosol® SP813S.

Reference is made to "Principles of Polymer Science and Technology in Cosmetics and Personal Care" by Goddard and Gruber and in particular to pages 260-261, where an additional list of suitable synthetic cationic polymers can be found.

C, Fabric Care Ingredient—

(c1) Cationic silicone polymer—The cationic silicone polymer selected for use in the present invention compositions comprises one or more polysiloxane units, preferably polydimethylsiloxane units of formula $—\{(CH_3)_2SiO\}_c—$ having a degree of polymerization, c, of from 1 to 1000, preferably of from 20 to 500, more preferably of from 50 to 300, most preferably from 100 to 200, and organosilicone-free units comprising at least one diquaternary unit. In a preferred embodiment of the present invention, the selected cationic silicone polymer has from 0.05 to 1.0 mole fraction, more preferably from 0.2 to 0.95 mole fraction, most preferably 0.5 to 0.9 mole fraction of the organosilicone-free units selected from cationic divalent organic moieties. The cationic divalent organic moiety is preferably selected from N,N,N',N'-tetramethyl-1,6-hexanediammonium units.

The selected cationic silicone polymer can also contain from 0 to 0.95 mole fraction, preferably from 0.001 to 0.5 mole fraction, more preferably from 0.05 to 0.2 mole fraction of the total of organosilicone-free units, polyalkyleneoxide amines of the following formula:

$$[—Y—O(—C_aH_{2a}O)_b—Y—]$$

wherein Y is a divalent organic group comprising a secondary or tertiary amine, preferably a $C_1$ to $C_8$ alkylenamine residue; a is from 2 to 4, and b is from 0 to 100. The polyalkyleneoxide blocks may be made up of ethylene oxide (a=2), propylene oxide (a=3), butylene oxide (a=4) and mixtures thereof, in a random or block fashion.

Such polyalkyleneoxide amine—containing units can be obtained by introducing in the silicone polymer structure, compounds such as those sold under the tradename Jeffamine® from Huntsman Corporation. A preferred Jeffamine is Jeffamine ED-2003.

The selected cationic silicone polymer can also contain from 0, preferably from 0.001 to 0.2 mole fraction, of the total of organosilicone-free units, of $—NR_3+$ wherein R is alkyl, hydroxyalkyl or phenyl. These units can be thought of as end-caps.

Moreover the selected cationic silicone polymer generally contains anions, selected from inorganic and organic anions, more preferably selected from saturated and unsaturated $C_1$-$C_{20}$ carboxylates and mixtures thereof, to balance the charge of the quaternary moieties, thus the cationic silicone polymer also comprises such anions in a quaternary charge-balancing proportion.

Conceptually, the selected cationic silicone polymers herein can helpfully be thought of as non-crosslinked or "linear" block copolymers including non-fabric-substantive but surface energy modifying "loops" made up of the polysiloxane units, and fabric-substantive "hooks". One preferred class of the selected cationic polymers (illustrated by Structure 1 hereinafter) can be thought of as comprising a single loop and two hooks; another, very highly preferred, comprises two or more, preferably three or more "loops" and two or more, preferably three or more "hooks" (illustrated by Structures 2a and 2b hereinafter), and yet another (illustrated by Structure 3 hereinafter) comprises two "loops" pendant from a single "hook".

Of particular interest in the present selection of cationic silicone polymers is that the "hooks" contain no silicone and that each "hook" comprises at least two quaternary nitrogen atoms.

Also of interest in the present selection of preferred cationic silicone polymers is that the quaternary nitrogen is preferentially located in the "backbone" of the "linear" polymer, in contradistinction from alternate and less preferred structures in which the quaternary nitrogen is incorporated into a moiety or moieties which form a "pendant" or "dangling" structure off the "backbone".

The structures are completed by terminal moieties which can be noncharged or charged. Moreover a certain proportion of nonquaternary silicone-free moieties can be present, for example the moiety [—Y—O(—$C_aH_{2a}$O)$_b$—Y—] as described hereinabove.

Of course the conceptual model presented is not intended to be limiting of other moieties, for example connector moieties, which can be present in the selected cationic silicone polymers provided that they do not substantially disrupt the intended function as fabric benefit agents.

In more detail, the cationic silicone polymers herein have one or more polysiloxane units and one or more quaternary nitrogen moieties, including polymers wherein the cationic silicone polymer has the formula: (Structure 1)

STRUCTURE 1

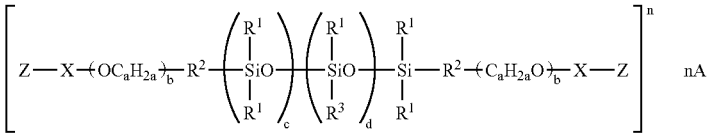

nA wherein:

$R^1$ is independently selected from the group consisting of: $C_{1-22}$ alkyl, $C_{2-22}$ alkenyl, $C_{6-22}$ alkylaryl, aryl, cycloalkyl, and mixtures thereof;

$R^2$ is independently selected from the group consisting of: divalent organic moieties that may contain one or more oxygen atoms (such moieties preferably consist essentially of C and H or of C, H and O);

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

Z is independently selected from the group consisting of monovalent organic moieties comprising at least one quaternized nitrogen atom;

a is from 2 to 4; b is from 0 to 100; c is from 1 to 1000, preferably greater than 20, more preferably greater than 50, preferably less than 500, more preferably less than 300, most preferably from 100 to 200;

d is from 0 to 100; n is the number of positive charges associated with the cationic silicone polymer, which is greater than or equal to 2; and A is a monovalent anion.

In a preferred embodiment of the Structure 1 cationic silicone polymers, Z is independently selected from the group consisting of:

(i)

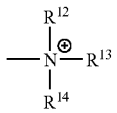

-continued (ii)

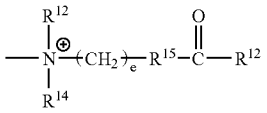

(iii)

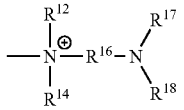

-continued (iv)

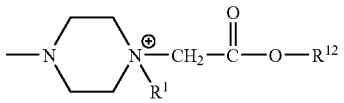

(v) monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; and e is from 1 to 6.

In a highly preferred embodiment, the cationic silicone polymers herein have one or more polysiloxane units and one or more quaternary nitrogen moieties, including polymers wherein the cationic silicone polymer has the formula: (Structure 2a)

STRUCTURE 2a: Cationic silicone polymer composed of alternating units of:

(i) a polysiloxane of the following formula

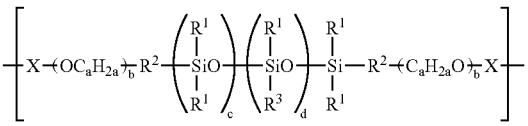

; and (ii) a divalent organic moiety comprising at least two quaternized nitrogen atoms.

Note that Structure 2a comprises the alternating combination of both the polysiloxane of the depicted formula and the divalent organic moiety, and that the divalent organic moiety is organosilicone-free corresponding to a preferred "hook" in the above description.

In this preferred cationic silicone polymer, $R^1$ is independently selected from the group consisting of: $C_{1-22}$ alkyl, $C_{2-22}$ alkenyl, $C_{6-22}$ alkylaryl, aryl, cycloalkyl, and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

a is from 2 to 4; b is from 0 to 100; c is from 1 to 1000, preferably greater than 20, more preferably greater than 50, preferably less than 500, more preferably less than 300, most preferably from 100 to 200; and d is from to 100.

In an even more highly preferred embodiment of the Structure 2a cationic silicone polymer, the cationic silicone polymer has the formula Structure 2b wherein the polysiloxane (i) of the formula described above in Structure 2a is present with (ii) a cationic divalent organic moiety selected from the group consisting of:

(a)

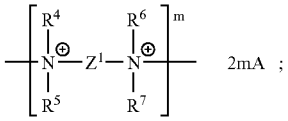

2mA ;

(b)

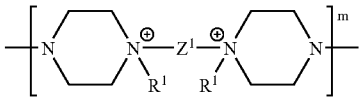

2mA ;

(c)

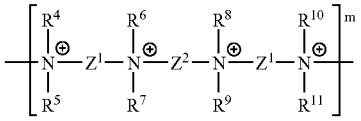

4mA ;

(d) a divalent aromatic or aliphatic heterocyclic group, substituted or unsubstituted, containing at least one quaternized nitrogent atom; and (iii) optionally, a polyalkyleneoxide amine of formula:

$$[—Y—O(—C_aH_{2a}O)_b—Y—]$$

Y is a divalent organic group comprising a secondary or tertiary amine, preferably a $C_1$ to $C_8$ alkylenamine residue; a is from 2 to 4; b is from 0 to 100; the polyalkyleneoxide blocks may be made up of ethylene oxide (a=2), propylene oxide (a=3), butylene oxide (a=4) and mixtures thereof, in a random or block fashion; and (iv) optionally, a cationic monovalent organic moiety, to be used as an end-group, selected from the group consisting of:

(i)

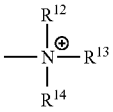

(ii)

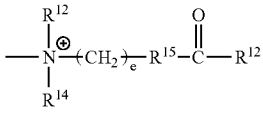

(iii)

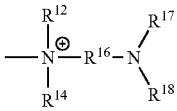

(iv)

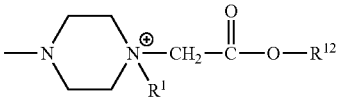

(v) monovalent aromatic or aliphatic heterocyclic group, substituted or unsubstituted, containing at least one quaternized nitrogen atom;

wherein:

$R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; or in which $R^4$ and $R^6$, or $R^5$ and $R^7$, or $R^8$ and $R^{10}$, or $R^9$ and $R^{11}$ may be components of a bridging alkylene group;

$R^{12}$, $R^{13}$, $R^{14}$ are the same or different, and are selected from the group consisting of: $C_{1-22}$ alkyl, $C_{2-22}$ alkenyl, $C_{6-22}$ alkylaryl, $C_{1-22}$ hydroxyalkyl, polyalkyleneoxide, (poly)alkoxy alkyl groups, and mixtures thereof; and $R^{15}$ is —O— or $NR^{19}$;

$R^{16}$ and $M^1$ are the same or different divalent hydrocarbon residues;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; and $Z^1$ and $Z^2$ are the same or different divalent hydrocarbon groups with at least 2 carbon atoms, optionally containing a hydroxy group, and which may be interrupted by one or several ether, ester or amide groups; wherein, expressed as fractions on the total moles of the organosilicone—free moieties, the cationic divalent organic moiety (ii) is preferably present at of from 0.05 to 1.0 mole fraction, more preferably of from 0.2 to 0.95 mole fraction, and most preferably of from 0.5 to 0.9 mole fraction; the polyalkyleneoxide amine (iii) can be present of from 0.0 to 0.95 mole fraction, preferably of from 0.001 to 0.5, and more preferably of from 0.01 to 0.2 mole fraction; if present, the cationic monovalent organic moiety (iv) is present of from 0 to 0.2 mole fraction, preferably of from 0.001 to 0.2 mole fraction;

e is from 1 to 6; m is the number of positive charges associated with the cationic divalent organic moiety, which is greater than or equal to 2; and A is an anion.

Note that Structure 2b comprises the alternating combination of both the polysiloxane of the depicted formula and the divalent organic moiety, and that the divalent organic moiety is organosilicone-free corresponding to a preferred "hook" in the above general description. Structure 2b moreover includes embodiments in which the optional polyalkyleneoxy and/or end group moieties are either present or absent.

In yet another embodiment, the cationic silicone polymers herein have one or more polysiloxane units and one or more quaternary nitrogen moieties, and including polymers wherein the cationic silicone polymer has the formula: (Structure 3)

STRUCTURE 3

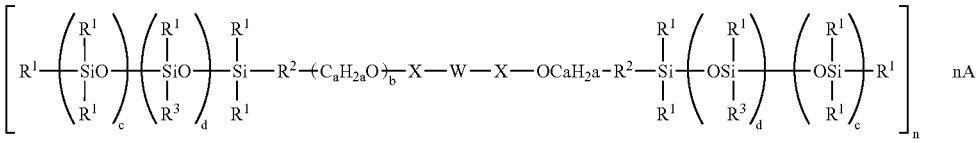

wherein:

$R^1$ is independently selected from the group consisting of: $C_{1-22}$ alkyl, $C_{2-22}$ alkenyl, $C_{6-22}$ alkylaryl, aryl, cycloalkyl, and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

X is independently selected from the group consisting of ring-opened epoxides;

W is independently selected from the group consisting of divalent organic moieties comprising at least one quaternized nitrogen atom;

a is from 2 to 4; b is from 0 to 100; c is from 1 to 1000, preferably greater than 20, more preferably greater than 50, preferably less than 500, more preferably less than 300, most preferably from 100 to 200; d is from 0 to 100; n is the number of positive charges associated with the cationic silicone polymer, which is greater than or equal to 1; and A is a monovalent anion, in other words, a suitable couterion.

In preferred cationic silicone polymers of Structure 3, W is selected from the group consisting of:

(a)

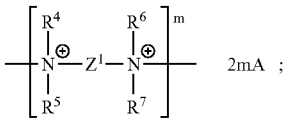

2mA ;

(b)

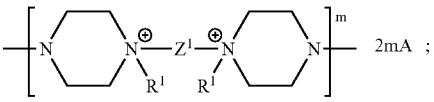

2mA ;

(c)

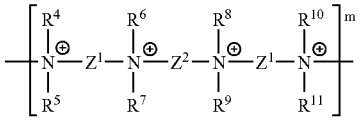

4mA ;

(d) a divalent aromatic or aliphatic heterocyclic group, substituted or unsubstituted, containing at least one quaternized nitrogent atom; and $R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; or in which $R^4$ and $R^6$, or $R^5$ and $R^7$, or $R^8$ and $R^{10}$, or $R^9$ and $R^{11}$ may be components of a bridging alkylene group; and $Z^1$ and $Z^2$ are the same or different divalent hydrocarbon groups with at least 2 carbon atoms, optionally containing a hydroxy group, and which may be interrupted by one or several ether, ester or amide groups.

Reference is made to the following patents and patent applications which do also disclose cationic silicone polymers suitable for use in the present invention: WO 02/06 403; WO 02/18 528, EP 1 199 350; DE OS 100 36 533; WO 00/24 853; WO 02/10 259; WO 02/10 257 and WO 02/10 256. If present, the cationic silicone-containing polymer is typically present at levels in the range of from 0.001% to 50%, preferably at least from 0.01% to 30%, more preferably from 0.1% to 10%, and most preferably from 0.2% to 5.0% by weight of the composition.

Synthesis Example—When not otherwise known or available in commerce, the cationic silicone polymers herein can be prepared by conventional techniques as disclosed in WO 02/18 528.

In a preferred embodiment, the liquid laundry detergent composition of the present invention comprises surfactants, a coacervate phase forming cationic polymer and one or more silicone polymers comprising one or more polysiloxane units and one or more nitrogen moieties and being essentially free of any further fabric care ingredient of one or more amino silicone polymers or a nitrogen-free silicone polymer and mixtures thereof.

(c2) Amino Silicone Polymer—Herein "aminosilicone" means any amine functionalized silicone; i.e., a silicone containing at least one primary amine, secondary amine, or tertiary amine. Preferred aminosilicones will typically have between 0.01% to 1% nitrogen, and more preferably between 0.05% to 0.5% nitrogen by weight of the aminosilicone. If present, the amino silicone polymer is typically present at levels in the range of from 0.001% to 50%, preferably at least from 0.01% to 30%, more preferably from 0.1% to 10%, and most preferably from 0.2% to 5.0% by weight of the composition.

Typically, the aminosilicone has a viscosity of from 0.001 $m^2/s$ (1,000 centistokes at 20° C.) to 0.05 $m^2/s$ (50,000 centistokes at 20° C.), more preferably 0.002 $m^2/s$ (2,000 centistokes at 20° C.) to 0.03 $m^2/s$ (30,000 centistokes at 20° C.), more preferably from 0.004 $m^2/s$ (4,000 centistokes at 20° C.) to 0.02 $m^2/s$ (20,000 centistokes at 20° C.).

Example preferred aminosilicones for use in the compositions of the present invention include but are not limited to, those which conform to the general formula (V):

$$(R_1)_aG_{3-a}—Si—(—OSiG_2)_n—(—OSiG_b(R_1)_{2-b})_m—O—SiG_{3-a}(R_1)_a$$

wherein G is hydrogen, phenyl, hydroxy, or $C_1$-$C_8$ alkyl, preferably methyl; a is 0 or an integer having a value from 1 to 3, preferably 1; b is 0, 1 or 2, preferably 1; n is a number from 0 to 1,999, preferably from 49 to 500; m is an integer from 1 to 2,000, preferably from 1 to 10; the sum of n and m is a number from 1 to 2,000, preferably from 50 to 500; $R_1$ is a monovalent radical conforming to the general formula $C_qH_{2q}L$, wherein q is an integer having a value from 2 to 8 and L is selected from the following groups: $—N(R_2)CH_2—CH_2—N(R_2)_2$; $—N(R_2)_2$; wherein $R_2$ is hydrogen, phenyl, benzyl, or a saturated hydrocarbon radical, preferably an alkyl radical from $C_1$ to $C_{20}$.

A preferred aminosilicone corresponding to formula (V) is the shown below in formula (VI):

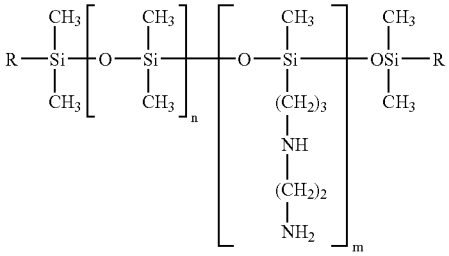

wherein R is independently selected from C1 to C4 alkyl, alkoxy, hydroxyalkyl and mixtures thereof, preferably from methyl and methoxy. When both R groups are methyl, the above polymer is known as "trimethylsilylamodimethicone".

Most preferred amino silicones are those commercially available from Wacker, sold under the tradename of Wacker Belsil® ADM 1100 and Wacker Finish® WR 1100, and from General Electric sold as General Electric® SF 1923.

(c3) Nitrogen-Free Silicone Polymer—

Suitable levels of this component are in the range from 0.0% to 90%, preferably from 0.01% to 50%, more preferably from 0.1% to 10%, and most preferably from 0.5% to 5.0% by weight of the composition.

The nitrogen-free silicone polymer selected for use in the compositions of the present inventions includes nonionic, zwitterionic and amphoteric nitrogen-free silicone polymers.

Preferably, the nitrogen-free silicone polymer is selected from nonionic nitrogen-free silicone polymers having the formulae (I) to (III):

(I)

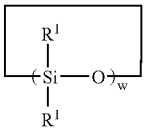

(II)

$$R^2—(R^1)_2SiO—[(R^1)_2SiO]_a—[(R^1)(R^2)SiO]_b—Si(R_1)_2—R^2$$

(III)

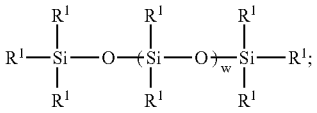

and mixtures thereof, wherein each $R^1$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl and arylalkenyl groups having from 7 to 20 carbon atoms and mixtures thereof; each $R^2$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl; arylalkenyl groups having from 7 to 20 carbon atoms and from a poly(ethyleneoxide/propyleneoxide) copolymer group having the general formula (IV):

$$—(CH_2)_nO(C_2H_4O)_c(C_3H_6O)_dR^3 \quad (IV)$$

with at least one $R^2$ being a poly(ethyleneoxy/propyleneoxy) copolymer group, and each $R^3$ is independently selected from the group consisting of hydrogen, an alkyl having 1 to 4 carbon atoms, and an acetyl group, wherein the index w has the value as such that the viscosity of the nitrogen-free silicone polymer of formulae (I) and (III) is between $2\cdot10^{-6}$ $m^2/s$ (2 centistokes at 20° C. at 20° C.) and 50 $m^2/s$ (50,000,000 centistokes at 20° C. at 20° C.); wherein a is from 1 to 50; b is from 1 to 50; n is 1 to 50; total c (for all polyalkyleneoxy side groups) has a value of from 1 to 100; total d is from 0 to 14; total c+d has a value of from 5 to 150.

More preferably, the nitrogen-free silicone polymer is selected from linear nonionic nitrogen-free silicone polymers having the formulae (II) to (III) as above, wherein $R^1$ is selected from the group consisting of methyl, phenyl, and phenylalkyl; wherein $R^2$ is selected from the group consisting of methyl, phenyl, phenylalkyl and from the group having the general formula (IV), defined as above; wherein $R^3$ is defined as above and wherein the index w has the value as such that the viscosity of the nitrogen-free silicone polymer of formula (III) is between 0.01 $m^2/s$ (10,000 centistokes at 20° C.) and 0.8 $m^2/s$ (800,000 centistokes at 20° C.); a is from 1 to 30, b is from 1 to 30, n is from 3 to 5, total c is from 6 to 100, total d is from 0 to 3, and total c+d is from 7 to 100.

Most preferably, the nitrogen-free silicone polymer is selected from linear nonionic nitrogen-free silicone polymers having the formula (III) as above, wherein $R^1$ is methyl and wherein the index w has the value as such that the viscosity of the nitrogen-free silicone polymer of formula (III) is between 0.06 $m^2/s$ (60,000 centistokes at 20° C.) and 0.7 $m^2/s$ (700,000 centistokes at 20° C.) and more preferably between 0.1 $m^2/s$ (100,000 centistokes at 20° C.) and 0.48 $m^2/s$ (480,000 centistokes at 20° C.), and mixtures thereof.

Non-limiting examples of nitrogen-free silicone polymers of formula (II) are the Silwet® compounds which are available from OSI Specialties Inc., a Division of Witco, Danbury, Conn. Non-limiting examples of nitrogen-free silicone polymers of formula (I) and (If) are the Silicone 200 fluid series from Dow Corning.

D, Coacervate Phase—The phrase "coacervate phase" includes all kinds of separated polymer phases known by the person skilled in the art such as disclosed in L. Piculell & B. Lindman, Adv. Colloid Interface Sci., 41 (1992) and in B. Jonsson, B. Lindman, K. Holmberg, & B. Kronberb, "Surfactants and Polymers In Aqueous Solution", John Wiley & Sons, 1998. The mechanism of coacervation and all its specific forms are fully described in "Interfacial Forces in Aqueous Media", C. J. van Oss, Marcel Dekker, 1994, pages 245 to 271. When using the phrase "coacervate phase", we usually refer to a term, which is occasionally expressed as "complex coacervate phase" or as "associated phase separation" in the literature.

The fabric treatment compositions of the present invention will form a coacervate. Generally for the purpose of the present invention, the coacervate is formed by an anionic component or by an anionic part of any other component and the coacervate phase forming cationic polymer.

Techniques for analysis of formation of coacervates are known in the art. For example, microscopic analyses of the compositions, at any chosen stage of dilution, can be utilized to identify whether a coacervate phase has formed. Such coacervate phase will be identifiable as an additional emulsified phase in the composition. The use of dyes can aid in distinguishing the coacervate phase from other insoluble phases dispersed in the composition.

When referring to the formation of a coacervate phase, it is meant and it is highly preferred that the coacervate phase is built upon dilution of the composition with a diluent during the laundry treatment application, e.g. during the wash cycle and/or during the rinse cycle. Also, when referring to the formation of a coacervate phase, it is meant that the coacervate phase can already be formed in the finished composition, although less preferred. If however, the coacervate phase is already built in the finished composition, it is highly preferred that the coacervate phase is suspended in a structured matrix.

E, Liquid Carrier—The liquid carrier in the present compositions can be aqueous or non-aqueous; and can include water alone or organic solvents alone and/or mixtures thereof. Preferred organic solvents include monohydric alcohols, dihydric alcohols, polyhydric alcohols, glycerol, glycols, polyalkylene glycols such as polyethylene glycol, and mixtures thereof. Highly preferred are mixtures of solvents, especially mixtures of lower aliphatic alcohols such as ethanol, propanol, butanol, isopropanol, and/or diols such as 1,2-propanediol or 1,3-propanediol; or mixtures thereof with glycerol. Suitable alcohols especially include a $C_1$-$C_4$ alcohol. Preferred is 1,2-propanediol. The liquid carrier is typically present at levels in the range of from 1% to 95%, preferably at least from 5% to 70%, more preferably from 10% to 50%, and most preferably from 15% to 30% by weight of the composition.

F, Diluent—During the laundry treatment application, e.g. during the wash cycle and/or during the rinse cycle, the fabric treatment compositions of the present invention are typically diluted with a diluent, which is preferably an aqueous composition, more preferably water.

G, Builder—The compositions of the present invention may optionally comprise a builder, at levels of from 0.0% to 80% by weight, preferably from 5% to 70% by weight, more preferably from 20% to 60% by weight of the composition.

In general any known detergent builder is useful herein, including inorganic types such as zeolites, layer silicates, fatty acids and phosphates such as the alkali metal polyphosphates, and organic types including especially the alkali metal salts of citrate, 2,2-oxydisuccinate, carboxymethyloxysuccinate, nitrilotriacetate and the like. Phosphate-free, water-soluble organic builders which have relatively low molecular weight, e.g., below 1,000, are highly preferred for use herein. Other suitable builders include sodium carbonate and sodium silicates having varying ratios of $SiO_2$:$Na_2O$ content, e.g., 1:1 to 3:1 with 2:1 ratio being typical.

Preferred are in particular $C_{12}$-$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$-$C_{18}$ topped whole cut fatty acids, or a mixture of rape seed-derived fatty acid and a tallow alcohol derived fatty acid, palmitic, oleic, fatty alkylsuccinic acids, and mixtures thereof. Further preferred are branched fatty acids of synthetic or natural origin, especially biodegradable branched types.

Mixtures of any of these fatty acid builders can be advantageous to further promote solubility. It is known that lower chain length fatty acids promote solubility but this needs to be balanced with the knowledge that they are often malodorous, e.g., at chain lengths of C9 and below.

While the term "fatty acid builder" is in common use, it should be understood and appreciated that as formulated in the present detergents, the fatty acid is in at least partially neutralized to neutralized form, the counter-ions can typically be alkanolamines, sodium, potassium, alkanolammonium or mixtures thereof. Preferably, the fatty acids are neutralized with alkanolamines such as Mono Ethanol Amine, and are fully soluble in the liquid phase.

Fatty acids are preferred builders in the compositions of the present invention. It has been found that the presence of fatty acid builders contribute to the formation of a coacervate. The presence of fatty acids builder in the compositions of the present invention is therefore highly preferred.

H, Enzymes—Suitable detersive enzymes for use herein include protease, amylase, cellulase, mannanase, endoglucanase, lipase and mixtures thereof. Enzymes can be used at their art-taught levels, for example at levels recommended by suppliers such as Novo and Genencor. Preferred levels in the compositions are from 0% to 5%, more preferably from 0.0001% to 5% by weight of the composition. When enzymes are present, they can be used at very low levels, e.g., from 0.001% or lower, in certain embodiments of the invention; or they can be used in heavier-duty laundry detergent formulations in accordance with the invention at higher levels, e.g., 0.1% and higher. In accordance with a preference of some consumers for "non-biological" detergents, the present invention includes both enzyme-containing and enzyme-free embodiments.

I, Suds Suppressing system—Suitable suds suppressing systems for use herein may comprise essentially any known antifoam compound or mixture, typically at a level less than 10%, preferably 0.001% to 10%, preferably from 0.01% to 8%, most preferably from 0.05% to 5%, by weight of the composition. Suitable suds suppressors can include low solubility components such as highly crystalline waxes and/or hydrogenated fatty acids, silicones, silicone/silica mixtures, or more sophisticated compounded suds suppressor combinations, for example those commercially available from companies such as Dow Corning. Compounded silicones are suitably used at levels of 0.005% to 0.5% by weight. More soluble antifoams include for example the lower 2-alkyl alkanols such as 2-methyl-butanol.

Other suitable suds suppressors include the fatty acids and described above under (G).

K, Laundry Adjunct Materials—

(a) Stabilizer—Compositions of the present invention may optionally comprise and preferably do comprise a stabilizer. Suitable levels of this component are in the range from 0.0% to 20%, preferably from 0.1% to 10%, and even more preferably from 0.1% to 3% by weight of the composition. The stabilizer serves to stabilize the cationic silicone polymer in the inventive compositions and to prevent it from coagulating and/or creaming. This is especially important when the inventive compositions have fluid form, as in the case of liquid or gel-form laundry detergents for heavy-duty or fine fabric wash use, and liquid or gel-form fabric treatments other than laundry detergents.

Stabilizers suitable for use herein can be selected from thickening stabilizers. These include gums and other similar polysaccharides, for example gellan gum, carrageenan gum, and other known types of thickeners and rheological additives other than highly polyanionic types; thus conventional clays are not included.

More preferably the stabilizer is a crystalline, hydroxyl-containing stabilizing agent, more preferably still, a trihydroxystearin, hydrogenated oil or a derivative thereof.

Without intending to be limited by theory, the crystalline, hydroxyl-containing stabilizing agent is a nonlimiting example of a "thread-like structuring system." "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Surfactants are not included within the definition of the thread-like structuring system. Without wishing to be bound by theory, it is believed that the thread-like structuring system forms a fibrous or entangled threadlike network in-situ on cooling of the matrix. The thread-like structuring system has an average aspect ratio of from 1.5:1, preferably from at least 10:1, to 200:1.

The thread-like structuring system can be made to have a viscosity of 0.002 $m^2/s$ (2,000 centistokes at 20° C.) or less at an intermediate shear range (5 $s^{-1}$ to 50 $s^{-1}$) which allows for the pouring of the detergent out of a standard bottle, while the low shear viscosity of the product at 0.1 $s^{-1}$ can be at least 0.002 $m^2/s$ (2,000 centistokes at 20° C.) but more preferably greater than 0.02 $m^2/s$ (20,000 centistokes at 20° C.). A process for the preparation of a thread-like structuring system is disclosed in WO 02/18528.

(b) Coupling agent—Coupling agents suitable for use herein include fatty amines other than those which have marked surfactant character or are conventional solvents (such as the lower alkanolamines). Examples of these coupling agents include hexylamine, octylamine, nonylamine and their C1-C3 secondary and tertiary analogs. Levels of this component, when present, are suitably in the range of from 0.1% to 20%, more typically 0.5% to 5% by weight of the composition.

A particularly useful group of coupling agents is selected from the group consisting of molecules which consist of two polar groups separated from each other by at least 5, preferably 6, aliphatic carbon atoms; preferred compounds in this group are free from nitrogen and include 1,4 Cyclo Hexane Di Methanol (CHDM), 1,6 Hexanediol, 1,7 Heptanediol and mixtures thereof. 1,4 Cyclo Hexane Di Methanol may be present in either its cis configuration, its trans configuration or a mixture of both configurations.

(c) Fabric substantive perfume—The fabric treatment compositions of the present invention can comprise perfume to provide a "scent signal" in the form of a pleasant odor which provides a freshness impression to the fabrics. The fabric substantive perfume ingredients are suitably at levels in the range from 0.0001% to 10% by weight of the composition and are characterized by their boiling points (B.P.). The fabric substantive perfume ingredients have a B.P, measured at the normal, standard pressure of 760 mm Hg, of 240° C. or higher, and preferably of 250° C. or higher. Preferably the fabric substantive perfume ingredients have a ClogP of greater than 3, more preferably from 3 to 6.

The preferred compositions used in the present invention contain at least 2, preferably at least 3, more preferably at least 4, even more preferably at least 5, even more preferably at least 6, and even more preferably at least 7 different fabric substantive perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

Nonlimiting examples of suitable fabric substantive perfume ingredients for use in the compositions of the present invention are disclosed in WO 02/18528.

(d) Chelating agent—Suitable chelating agents for use herein include nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelating agents such as compounds of the general class of certain macrocyclic N-ligands such as those known for use in bleach catalyst systems. Levels of chelating agents are typically lower than 5%, more typically, chelating agents, when present, are at levels of from 0.01% to 3%.

(e) Effervescent system—Effervescent systems suitable herein include those derived by combining an acid and a bicarbonate or carbonate, or by combining hydrogen peroxide and catalase, or any other combination of materials which release small bubbles of gas. The components of the effervescent system may be dispensed in combination to form the effervescence when they are mixed, or can be formulated together provided that conventional coatings or protection systems are used. Levels of effervescent system can vary very widely, for example effervescent components together can range from 0.1% to 30% of the composition. Hydrogen peroxide and catalase are very mass efficient and can be at much lower levels with excellent results.

(f) Surfactants—The present compositions may optionally comprise and preferably do comprise at least additional one surfactant selected from the group consisting of cationic surfactants, nonionic surfactants, amine-functional and amide-functional surfactants and mixtures thereof. Suitable levels of this component are in the range from 0.0% to 80%, preferably from 5.0% to 65%, more preferably from 10% to 50% by weight of the composition.

(f1) Nonionic Surfactants—The present compositions may optionally comprise and preferably do comprise this type of detersive surfactant. Suitable levels of this component are in the range from 0.0% to 80%, preferably from 0.1% to 50%, more preferably from 1% to 30% by weight of the composition. Essentially any alkoxylated nonionic surfactant, suitably one containing only carbon, hydrogen and oxygen can be included in the present compositions, although amidofunctional and other heteroatom-functional types can in general also be used. Ethoxylated, propoxylated, butoxylated or mixed alkoxylated, for example ethoxylated/propoxylated aliphatic or aromatic hydrocarbyl chain nonionic surfactants are preferred. Suitable hydrocarbyl moieties can contain from 6 to 22 carbon atoms and can be linear, branched, cycloaliphatic or aromatic and the nonionic surfactant can be derived from a primary or secondary alcohol.

Preferred alkoxylated surfactants can be selected from the classes of the nonionic condensates of ethoxylated and ethoxylated/propoxylated or propoxylated/ethoxylated linear or lightly branched monohydric aliphatic alcohols, which can be natural or synthetic. Alkylphenyl alkoxylates such as the nonylphenyl ethoxylates can also suitably be used.

Especially suitable as nonionic surfactant or cosurfactant are the condensation products of primary aliphatic alcohols with from 1 to 75 moles of $C_2$-$C_3$ alkylene oxide, more suitably 1 to 15 moles, preferably 1 to 11 moles. Particularly preferred are the condensation products of alcohols having an alkyl group containing from 8 to 20 carbon atoms with from 2 to 9 moles and in particular 3 or 5 moles, of ethylene oxide per mole of alcohol.

Suitable nonionic surfactants containing nitrogen as heteroatom include the polyhydroxy fatty amides having the structural formula $R^1CONR^2Z$ wherein $R^1$ is a $C_5$-$C_3$, hydrocarbyl, preferably straight-chain $C_7$-$C_{19}$ alkyl or alkenyl, more preferably straight-chain $C_{11}$-$C_{17}$ alkyl or alkenyl, or mixture thereof; $R^2$ is H, $C_{1-18}$, preferably $C_1$-$C_4$ hydrocarbyl, 2-hydroxethyl, 2-hydroxypropyl, ethoxy, propoxy, or a mixture thereof, preferably $C_1$-$C_4$ alkyl, more preferably methyl; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar such as glucose, a corresponding preferred compound being a $C_{11}$-$C_{17}$ alkyl N-methyl glucamide.

Other nonionic surfactants useful herein include the so-called "capped" nonionics in which one or more —OH moieties are replaced by —OR wherein R is typically lower alkyl such as $C_1$-$C_3$ alkyl; the long-chain alkyl polysaccharides, more particularly the polyglycoside and/or oligosaccharide type, as well as nonionic surfactants derivable by esterifying fatty acids.

(f2) Cationic nitrogen-containing detersive surfactants—Cationic nitrogen-containing detersive surfactants suitable for use in the compositions of the present invention have at least one quaternized nitrogen and one long-chain hydrocarbyl group. Compounds comprising two, three or even four long-chain hydrocarbyl groups are also included. Examples of such cationic surfactants include alkyltrimethylammonium salts or their hydroxyalkyl substituted analogs, preferably compounds having the formula $R_1R_2R_3R_4N^+X^-$. $R_1$, $R_2$, $R_3$ and $R_4$ are independently selected from $C_1$-$C_{26}$ alkyl, alkenyl, hydroxyalkyl, benzyl, alkylbenzyl, alkenylbenzyl, benzylalkyl, benzylalkenyl and X is an anion. The hydrocarbyl groups $R_1$, $R_2$, $R_3$ and $R_4$ can independently be alkoxylated, preferably ethoxylated or propoxylated, more preferably ethoxylated with groups of the general formula $(C_2H_4O)_xH$ where x has a value from 1 to 15, preferably from 2 to 5. Not more than one of $R_2$, $R_3$ or $R_4$ should be benzyl. The hydrocarbyl groups $R_1$, $R_2$, $R_3$ and $R_4$ can independently comprise one or more, preferably two, ester —([—O—C(O)-]; [—C(O)—O—]) and/or an amido-groups ([O—N(R)—]; [—N(R)—O—]) wherein R is defined as $R_1$ above. The anion X may be selected from halide, methysulfate, acetate and phosphate, preferably from halide and methylsulfate, more preferably from chloride and bromide. The $R_1$, $R_2$, $R_3$ and $R_4$ hydrocarbyl chains can be fully saturated or unsaturated with varying Iodine value, preferably with an Iodine value of from 0 to 140. At least 50% of each long chain alkyl or alkenyl group is predominantly linear, but also branched and/or cyclic groups are included.

For cationic surfactants comprising only one long hydrocarbyl chain, the preferred alkyl chain length for $R_1$ is $C_{12}$-$C_{15}$ and preferred groups for $R_2$, $R_3$ and $R_4$ are methyl and hydroxyethyl.

For cationic surfactants comprising two or three or even four long hydrocarbyl chains, the preferred overall chain length is $C_{18}$, though mixtures of chainlengths having non-zero proportions of lower, e.g., $C_{12}$, $C_{14}$, $C_{16}$ and some higher, e.g., $C_{20}$ chains can be quite desirable.

Preferred ester-containing surfactants have the general formula $$\{(R_5)_2N((CH_2)_nER_6)_2\}^+X^-$$

wherein each $R_5$ group is independently selected from $C_{1-4}$ alkyl, hydroxyalkyl or $C_{2-4}$ alkenyl; and wherein each $R_6$ is independently selected from $C_{8-28}$ alkyl or alkenyl groups; E is an ester moiety i.e., —OC(O)— or —C(O)O—, n is an integer from 0 to 5, and $X^-$ is a suitable anion, for example chloride, methosulfate and mixtures thereof.

A second type of preferred ester-containing cationic surfactant can be represented by the formula: $\{(R_5)_3N(CH_2)_nCH(O(O)CR_6)CH_2O(O)CR_6\}^+X^-$ wherein $R_5$, $R_6$, X, and n are defined as above. This latter class can be exemplified by 1,2 bis[hardened tallowoyloxy]-3-trimethylammonium propane chloride.

The cationic surfactants, suitable for use in the compositions of the present invention can be either water-soluble, water-dispersable or water-insoluble.

(f3) Amine- and Amide-Functional Surfactants—A preferred group of these surfactants are amine surfactants, preferably an amine surfactant having the formula $RX(CH_2)_xNR^2R^3$ wherein R is $C_6$-$C_{12}$ alkyl; X is a bridging group which is selected from NH, CONH, COO, or O or X can be absent; x is from 2 to 4; $R_2$ and $R_3$ are each independently selected from H, $C_1$-$C_4$ alkyl, or ($CH_2$—$CH_2$—O($R_4$)) wherein $R_4$ is H or methyl. Particularly preferred surfactants of this type include those selected from the group consisting of decyl amine, dodecyl amine, $C_8$-$C_{12}$ bis(hydroxyethyl)amine, $C_8$-$C_{12}$ bis(hydroxypropyl)amine, $C_8$-$C_{12}$ amido propyl dimethyl amine, and mixtures thereof.

This group of surfactants also includes fatty acid amide surfactants having the formula $RC(O)NR'_2$ wherein R is an alkyl group containing from 10 to 20 carbon atoms and each R' is a short-chain moiety preferably selected from the group consisting of hydrogen and $C_1$-$C_4$ alkyl and hydroxyalkyl. The $C_{10}$-$C_{18}$ N-alkyl polyhydroxy fatty acid amides can also be used. Typical examples include the $C_{12}$-$C_{18}$ N-methylglucamides. See WO 92/06154. Other sugar-derived nitrogen-containing nonionic surfactants include the N-alkoxy polyhydroxy fatty acid amides, such as $C_{10}$-$C_{18}$ N-(3-methoxypropyl) glucamide.

(g) Other adjuncts—Examples of other suitable cleaning adjunct materials include, but are not limited to, alkoxylated benzoic acids or salts thereof such as trimethoxy benzoic acid or a salt thereof (TMBA), conventional (not fabric substantive) perfumes and pro-perfumes, bleaches, bleach activators, bleach catalysts, enzyme stabilizing systems, optical brighteners or fluorescers, soil release polymers, dispersants or polymeric organic builders including water-soluble polyacrylates, acrylate/maleate copolymers and the like, dyes, colorants, filler salts such as sodium sulfate, hydrotropes such as toluenesulfonates, cumenesulfonates and naphthalenesulfonates, photoactivators, hydrolyzable surfactants, preservatives, anti-oxidants, anti-shrinkage agents, anti-wrinkle agents, germicides, fungicides, color speckles, colored beads, spheres or extrudates, sunscreens, fluorinated compounds, clays, pearlescent agents, luminescent agents or chemiluminescent agents, anti-corrosion and/or appliance protectant agents, alkalinity sources or other pH adjusting agents, solubilizing agents, carriers, processing aids, pigments, free radical scavengers, and pH control agents. Suitable materials include those described in U.S. Pat. Nos. 5,705,464, 5,710,115, 5,698,504, 5,695,679, 5,686,014 and 5,646,101.

Process for Preparing the Fabric Treatment Composition

The liquid detergent compositions of the present invention can be prepared in any suitable manner and can, in general, involve any order of mixing or addition. However, there are preferred ways to make such preparations.

Process A: The first step involves the preparation of a premix comprising the coacervate phase forming cationic polymer and the fabric care ingredient. Optionally, it may be desirable that the cationic polymer is present as an aqueous solution when combining it with the fabric care ingredient and optionally, it may be desirable that the fabric care ingredient is present as an emulsion in water when combining it with the cationic polymer. The second step involves the preparation of a second premix comprising all other remaining laundry adjunct ingredients. The third step involves the combination of the two premixes cited above.

Process B: The first step involves the preparation of a premix comprising all other ingredients except the coacervate phase forming polymer and except the fabric care ingredient. In a second step, the coacervate phase forming polymer is added to the premix of the first step, wherein the coacervate phase forming polymer is optionally present in form of an aqueous solution. In the third step, the fabric care ingredient which is optionally present as an emulsion in water is added to the mixture of the second step.

The processes for preparing the liquid laundry detergent compositions of the present invention is preferably carried out using conventional high-shear mixing means. This ensures proper dispersion of the fabric care ingredient and of the coacervate phase forming cationic polymer.

Liquid detergent compositions in accordance with the invention preferably comprise a stabilizer, especially preferred being trihydroxystearin or hydrogenated castor oil, for example the type commercially available as Thixcin®. When a stabilizer is to be added to the present compositions, it is preferably introduced as a separate stabilizer premix with one or more of the adjuncts, or non-silicone components, of the composition. When such a stabilizer premix is used, it is preferably added into the composition after the fabric care ingredient has already been introduced and dispersed in the composition.

When more than one fabric care ingredient is incorporated in the compositions of the present invention, it is highly preferred to premix these fabric care ingredients previously before combining them with any other ingredient of the final liquid laundry detergent compositions of the present invention.

Forms and types of the Compositions—The liquid laundry detergent composition of the present invention may be in any form, such as liquids (aqueous or non-aqueous), pastes, and gels. Unitized dose compositions are included, as are compositions, which form two or more separate but combined dispensable portions. The liquid compositions can also be in a "concentrated" or diluted form. Preferred liquid laundry detergent compositions of the present invention include liquids, more preferably heavy duty liquid fabric treatment compositions and liquid laundry detergents for washing 'standard', non-fine fabrics as well as fine fabrics including silk, wool and the like. Compositions formed by mixing the provided compositions with water in widely ranging proportions are included.

The liquid laundry detergent composition of the present invention may also be present in form of a rinse-added composition for delivering fabric care benefits, e.g., in form of a rinse-added fabric-softening composition, or in form of a fabric finishing composition, or in form of a wrinkle-reduction composition.

The liquid laundry detergent compositions of the present invention may be in the form of spray compositions, preferably contained within a suitable spray dispenser. The present invention also includes products in a wide range of types such as single-phase compositions, as well as dual-phase or even multi-phase compositions. The liquid laundry detergent compositions of the present invention may be incorporated and stored in a single-, dual-, or multi-compartment bottle.

Method of Treating Fabrics and Uses of Compositions of the Invention in Relation to Form—

The term "substrate" as used herein means a substrate, especially a fabric or garment, having one or more of the fabric care benefits described herein as imparted thereto by a composition of the present invention.

A method of treating a substrate comprising the steps of contacting the substrate with the liquid laundry detergent composition of the present invention is included in the present invention. As used herein, "liquid laundry detergent compositions" include liquid laundry detergent compositions for handwash, machine wash and other purposes including fabric care additive compositions and compositions suitable for use in the soaking and/or pretreatment of stained fabrics. In the context of this invention, contacting of fabrics with the compositions herein can include direct application of the compositions to fabrics or application of the compositions to fabrics via an aqueous wash, rinse or fabric treatment liquor formed from such a composition. Concentrations of the composition in such aqueous liquor will typically range from 0.01% to 10% by weight of the final aqueous liquor.

EXAMPLES

The following non-limiting examples are illustrative of the present invention. Percentages are by weight unless otherwise specified.

For purposes of this invention, viscosity is measured with a Carrimed CSL2 Rheometer at a shear rate of 21 $s^{-1}$.

Example 1

The final fabric treatment composition is formulated by combining two premixes: a fabric cleaning premix A according to formula A1 as below and a fabric care premix B as below.

Fabric Cleaning Premix A:

| Formula A1 | Wt % (raw materials at 100% activity) |
|---|---|
| C13-15 alkylbenzene sulphonic acid | 13.0 |
| C14-15 EO8 (1) | 9.0 |
| C12-14 alkyl dimethyl amineoxide (2) | 1.5 |
| C12-18 fatty acid | 10.0 |
| Citric acid | 4.0 |
| Diethylene triamine pentamethylene phosphonic acid | 0.3 |
| Hydroxyethane dimethylene phosphonic acid | 0.1 |
| Ethoxylated polyethylene imine | 1.0 |
| Ethoxylated tetraethylene pentamine | 1.0 |
| Fluorescent whitening agent | 0.15 |
| $CaCl_2$ | 0.02 |
| Propanediol | 5.0 |
| Ethanol | 2.0 |
| Sodium cumene sulphonate | 2.0 |

-continued

| Formula A1 | Wt % (raw materials at 100% activity) |
|---|---|
| NaOH | to pH 7.5 |
| Protease enzyme | 0.75 |
| Amylase enzyme | 0.20 |
| Cellulase enzyme | 0.05 |
| Hydrogenated castor oil | 0.2 |
| Dye | 0.001 |
| Perfume | 0.70 |
| Water | Balance |

(1) Marlipal 1415/8.1 ex Sasol
(2) C12-14 alkyl dimethyl amineoxide ex P&G, supplied as a 31% active solution in water The preparation of Fabric Care premix B is divided into three steps:

1. Preparation of coacervate phase forming cationic polymer solution (premix B1): 5.0 g of N-Hance 3196 ex Aqualon is added to 493 g of demineralized water under stirring with a normal laboratory blade mixer (type: Janke & Kunkel, IKA-Labortechnik RW 20). After 10 minutes of stirring, the pH of the mixture is brought to pH 6.5-7.0 by adding 2.0 g of 0.1M HCl. The mixture is further stirred for another 15 minutes.

2. Preparation of the cationic silicone premix (premix B2): 24.39 g of cationic silicone solution (3) is mixed with 6.05 g C12-15 EO3 (4) with a normal laboratory blade mixer. After 10 minutes, 6.7 g of ethanol is added. After another 10 minutes, 8.71 g of C12-14 alkyl dimethyl amineoxide 31% active solution in water (2) is added. After another 10 minutes, 54.2 g of demineralized water are quickly added to the mixture, under continuous stirring. The pH of the premix is brought to pH 7.5 with 0.8 g 0.1 M HCl.

3. Combination of the two premixes B1 and B2: 60.0 g of premix B2 are added to 100.0 g of premix B1 and stirred for 15 minutes with a normal laboratory blade mixer.

The final fabric treatment composition is formulated by adding 16.0 g of premix B (combined premixes B1 and B2) to 100 g of premix A by using a normal laboratory blade mixer.

(3) Cationic silicone structure as in structure 2b: (i) with: $R^1$, $R^3$=$CH_3$, $R^2$=$(CH_2)_3$, X=$CH_2CHOHCH_2$, a=0; b=1; c=150; d=0; cationic divalent moiety: ii(a) with $R^4$, $R^5$, $R^6$, $R^7$ all $CH_3$ and $Z^1$ is $(CH_2)_6$. A=50% by mole of acetate, 50% by mole of laurate, m=2; polyalkyleneoxide amine moiety (iii) is —$NHCH(CH_3)CH_2$—$[OCH(CH_3)CH_2]_r$—$[OCH_2CH_2]_{38.7}$—$[OCH_2CH(CH_3)]_z$—NH—with r+z=6.0; cationic monovalent moiety iv(i) has $R^{12}$, $R^{13}$ and $R^{14}$ all methyl. The mole fractions of the cationic divalent moeity (ii) of the polyalkyleneoxide amine moeity (iii) and of the cationic monovalent amine moiety (iv) are respectively 0.8, 0.1 and 0.1 expressed as fractions of the total moles of the organosilicone—free moieties. The cationic silicone is present as a 72.1 wt.-% solution in ethanol.

(4) Neodol 25-3 ex Shell Chemicals.

Example 2

The final fabric treatment composition is formulated by combining three premixes: a fabric cleaning premix A according to formula A1 as above and two fabric care premixes C1 and C2 as below.

1. Preparation of fabric care premix C1 (coacervate phase forming cationic polymer solution): see above as for premix B1.

2. Preparation of fabric care premix C2 (cationic silicone plus polydimethylsiloxane (PDMS)): 24.39 g of cationic silicone solution (3) and 40.0 g of PDMS 0.1 $m^2/s$ (100,000 centistokes at 20° C.)(5) are mixed, using a normal laboratory blade mixer. The premix is stirred for 20 minutes.

To formulate the final fabric treatment composition, 10.0 g of premix C1 is mixed with 100 g of premix A by using a normal laboratory blade mixer. After 10 minutes stirring, the product is stirred as to get a good vortex and 1.61 g of premix C2 is added via a syringe. The final composition is stirred for another 15 minutes as to get a good dispersion of the silicone component(s).

(5) Polydimethylsiloxane (PDMS) 0.1 $m^2/s$ (100,000 centistokes at 20° C.) (Dow Corning silicone 200 Fluid series).

Example 3

The final fabric treatment composition is formulated by combining two premixes and by combining with these combined premixes the fabric care ingredient. The two premixes mentioned above are the fabric cleaning premix A according to formula A1 as above and the coacervate phase forming cationic polymer premix according to premix B1 as above.

To formulate the final fabric treatment composition, 10.0 g of premix B1 is mixed with 100 g of premix A by using a normal laboratory blade mixer. After 10 minutes stirring, the product is stirred as to get a good vortex and 1.50 g of the amino silicone polymer fluid (General Electric® SF 1923) is added via a syringe. The final composition is stirred for another 15 minutes as to get a good dispersion of the silicone component(s).

The composition of Example 3 is particularly advantageous with respect to color care benefits imparted to fabrics treated therewith. The composition of Example 3 is also particularly advantageous with respect to fabric softening benefits imparted to fabrics treated therewith; this is especially true for colored fabrics on which the observed fabric softening benefits are even more enhanced in comparison to the fabric softening benefits provided onto white fabrics. The composition of Example 3 is also advantageous with respect to anti-abrasion benefits and to anti-pilling benefits provided for fabrics treated therewith.

Comparative Performance Data

The following data demonstrate the benefits provided with respect to on fabric softness, anti-abrasion and anti-pilling imparted to fabrics laundered with a liquid laundry detergent composition (Composition C) of the present invention:

Example 4

Compositions Tested

| | A | B | C |
|---|---|---|---|
| C14-15 Alcohol Ethoxylate EO8 | 8.5 | 8.5 | 8.5 |
| C13-15 Linear Alkylbenzene Sulphonic Acid | 12.0 | 12.0 | 12.0 |
| C12-14 Alkyl Aminoxide | 1.5 | 1.5 | 1.5 |
| C12-14 Alcohol Ethoxylate | 0.5 | 0.5 | 0.5 |
| Citric Acid | 3.5 | 3.5 | 3.5 |
| C12-18 Topped Plain Kernel Fatty Acids | 8.5 | 8.5 | 8.5 |
| Ethanol | 1.5 | 1.5 | 1.5 |

-continued

| | A | B | C |
|---|---|---|---|
| 1,2 Propanediol | 5.0 | 5.0 | 5.0 |
| Mono Ethanol Amine | 1.5 | 1.5 | 1.5 |
| NaOH | to pH 7.8 | to pH 7.8 | to pH 7.8 |
| Na Cumene Sulphonate | 2.0 | 2.0 | 2.0 |
| Hydrogenated Castor Oil | 0.3 | 0.3 | 0.3 |
| Ethoxylated Tetraethylene Pentamine | 1.0 | 1.0 | 1.0 |
| Ethoxylated Poly Ethylene Imine | 1.0 | 1.0 | 1.0 |
| Di Ethylene Triamine | 0.5 | 0.5 | 0.5 |
| Pentamethylene Phosphonic Acid Na Salt | | | |
| Aminosilicone (6) | — | 1.5 | 1.5 |
| Cationic Guar Gum (7) | — | — | 0.1 |
| Water, Enzymes, Aesthetics and Brightener | Up to 100 | Up to 100 | Up to 100 |

(6) Wacker Belsil ADM1100 from Wacker;
(7) N-Hance 3196 from Aqualon.

Test Conditions:

Formulations A, B and C are used at 100 g dosage to wash 3.2 kg cotton load comprising 58% white and 42% dark colored garments. 5 cumulative washing cycles are performed in a Miele washing machine, operating a 40° C. (short wash cycle). The fabrics are tumble dried after each wash. The fabrics are graded for softness and visual appearance (anti-pilling, fabric abrasion) by expert graders after 5 cumulative washes, using a scale of Panel Score Units (PSU).

Test Results:

1. Softness of Colored Fabrics (PSU after 5 Cycles)

| | A | B | C |
|---|---|---|---|
| ABC Plus (print - on polycotton) | Ref. | +1.8 | +2.3 |
| Navy Jumper (blue cotton) | Ref. | −0.5 | +1.5 |
| Black T-shirt (B&C - cotton) | Ref. | +1.3 | +2.8 |
| Black socks (cotton/nylon/lycra) | Ref. | +1.3 | +2.8 |
| Average softness of colored fabrics | Ref. | +1.0 | +2.4 |

2. Visual Appearance (Anti-Pilling, Fabric Abrasion) Benefits Provided for Colored Fabrics (PSU after 5 Cycles)

| | A | B | C |
|---|---|---|---|
| ABC Plus (print - on polycotton) | Ref. | 0.0 | +1.8 |
| Navy Jumper (blue cotton) | Ref. | +1.0 | +1.5 |
| Black T-shirt (B&C - cotton) | Ref. | +0.3 | +1.0 |
| Black socks (cotton/nylon/lycra) | Ref | +0.8 | +1.0 |
| Average fabric appearance for colored fabrics | Ref. | +0.5 | +1.3 |

3. Softness of White Fabrics (PSU after 5 Cycles)

| | A | B | C |
|---|---|---|---|
| Polycotton 50/50 | Ref. | +1.0 | +2.0 |
| CW 120 (cotton | Ref. | +1.0 | +1.8 |
| Terry cotton | Ref. | +1.5 | +2.3 |
| Average softness of white fabrics | Ref. | +1.2 | +2.0 |

Similar test results can be obtained for all benefits tested under U.S. washing conditions.

Conclusion:

The test results for Example 4 show that improved performance in terms of fabric softening, anti-pilling, fabric abrasion or any combination thereof versus the reference compositions is obtained on colored fabrics and on white fabrics. The tests further demonstrate that the benefit provided on colored fabrics is even more enhanced than on white fabrics. Amino silicones in combination with cationic guar gums are especially well performing.

Example 5

Three more detergent compositions were tested to test the benefit provided by compositions of the present invention (Compositions B and C) containing different types of the fabric care ingredients.

Compositions Tested:

| | A | B | C |
|---|---|---|---|
| C14-15 Alcohol Ethoxylate EO8 | 8.5 | 8.5 | 8.5 |
| C13-15 Linear Alkylbenzene Sulphonic Acid | 12.0 | 12.0 | 12.0 |
| C12-14 Alkyl Aminoxide | 1.5 | 1.5 | 1.5 |
| C 12-14 Alcohol Ethoxylate | 0.5 | 0.5 | 0.5 |
| Citric Acid | 3.5 | 3.5 | 3.5 |
| C12-18 Topped Plain Kernel Fatty Acids | 8.5 | 8.5 | 8.5 |
| Ethanol | 1.5 | 1.5 | 1.5 |
| 1,2 Propanediol | 5.0 | 5.0 | 5.0 |
| Mono Ethanol Amine | 1.5 | 1.5 | 1.5 |
| NaOH | to pH 7.8 | to pH 7.8 | to pH 7.8 |
| Na Cumene Sulphonate | 2.0 | 2.0 | 2.0 |
| Hydrogenated Castor Oil | 0.3 | 0.3 | 0.3 |
| Ethoxylated Tetraethylene Pentamine | 1.0 | 1.0 | 1.0 |
| Ethoxylated Poly Ethylene Imine | 1.0 | 1.0 | 1.0 |
| Di Ethylene Triamme | 0.5 | 0.5 | 0.5 |
| Pentamethylene Phosphonic Acid Na Salt | | | |
| Aminosilicone (6) | — | 1.5 | — |
| Cationic Guar Gum (7) | — | 0.1 | 0.1 |
| Polydimethylsiloxane (8) | — | — | 1.5 |
| Water, Enzymes, Aesthetics and Brightener | Up to 100 | Up to 100 | Up to 100 |

(6) Wacker Belsil ADM1100 from Wacker;
(7) N-Hance 3196 from Aqualon.
(8) Polydimethylsiloxane (PDMS) 0.6 $m^2/s$ (600,000 centistokes at 20° C.) (Dow Corning silicone 200 Fluid series)

Test Conditions:

Formulations A, B and C are used at 100 g dosage to wash 3.2 kg cotton load comprising 14% white and 86% dark colored garments. 10 cumulative washing cycles are performed in a Miele washing machine, operating a 40° C. (short wash cycle). The fabrics are tumble dried after each wash. The fabrics are graded for softness and visual appearance (anti-pilling, fabric abrasion) by expert graders after 10 cumulative washes, using a scale of Panel Score Units (PSU).

Test Results:

1. Softness of Colored Fabrics (PSU after 10 Cycles)

| | A | B | C |
|---|---|---|---|
| ABC Plus (print - on polycotton) | Ref. | +3.0 | +1.3 |
| Navy Jumper (blue cotton) | Ref. | +2.0 | +1.0 |
| Black T-shirt (B&C - cotton) | Ref. | +1.0 | +1.0 |
| Black socks (cotton/nylon/lycra) | Ref. | +2.0 | +0.3 |
| Average softness of colored fabrics | Ref. | +2.0 | +0.9 |

2. Visual Appearance (Anti-Pilling, Fabric Abrasion) Benefits Provided for Colored Fabrics (PSU After 10 Cycles)

| | A | B | C |
|---|---|---|---|
| Navy Jumper (blue cotton) | Ref. | +1.8 | +0.5 |
| Black T-shirt (B&C - cotton) | Ref. | +1.0 | +1.0 |
| Average fabric appearance for colored fabrics | Ref. | +1.4 | +0.75 |

Similar test results can be obtained for all benefits tested under U.S. washing conditions.

Conclusion:

The test results for Example 5 show that improved performance in terms of fabric softening, anti-pilling, fabric abrasion or any combination thereof versus the reference composition is obtained. The tests further demonstrate that amino silicones in combination with cationic guar gums are especially well performing.

What is claimed is:

1. A liquid laundry detergent composition comprising (a) at least one detergent ingredient selected from the group consisting of anionic surfactants, zwitterionic surfactants, amphoteric surfactants, and mixtures thereof;

(b) a coacervate phase forming cationic polymer selected from substituted and unsubstituted polyquaternary ammonium compounds, cationically modified polysaccharides, cationically modified (meth)acrylamide polymers, cationically modified (meth)acrylamide copolymers, cationically modified (meth)acrylate polymers, cationically modified (meth)acrylate copolymers, chitosan, quaternized vinylimidazole polymers, quaternized vinylimidazole copolymers, dimethyldiallylammonium polymers, dimethyldiallylammonium copolymers, polyethylene imine based polymers, and mixtures thereof;

(c) one or more fabric care ingredients selected from cationic silicone polymer according to the formula:

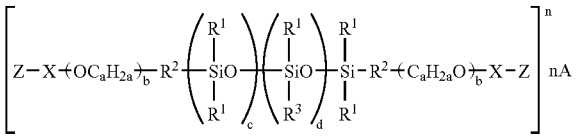

wherein:

$R^1$ is independently selected from the group consisting of $C_{1-22}$ alkyl, $C_{2-22}$ alkenyl, $C_{6-22}$ alkylaryl, aryl, cycloalkyl, and mixtures thereof;

$R^2$ is independently selected from the group consisting of divalent organic moieties;

X is independently selected from the group consisting of ring-opened epoxides;

$R^3$ is independently selected from polyether groups having the formula:

$$—M^1(C_aH_{2a}O)_b—M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl and mixtures thereof;

Z is independently selected from the group consisting of monovalent organic moieties comprising at least one quaternized nitrogen atom;

a is from about 2 to about 4; b is from 0 to about 100; c is from about 1 to about 1000; d is from 0 to about 100; n is the number of positive charges associated with the cationic silicone polymer, which is greater than or equal to about 2; and A is a monovalent anion;

(d) one or more enzymes; and (e) a liquid carrier.

2. A liquid laundry detergent composition according to claim 1 further comprising at least one compound selected from the group consisting of (a) builders;

(b) suds suppressor systems; and (c) mixtures thereof.

3. A liquid laundry detergent composition according to claim 1 wherein Z is independently selected from the group consisting of:

(i)

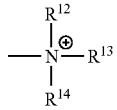

(ii)

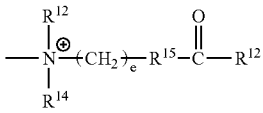

(iii)

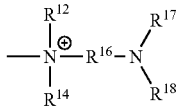

(iv)

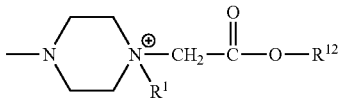

(v) monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl polyalkyleneoxide (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl and mixtures thereof; and e is from about 1 to about 6.

4. A liquid laundry detergent composition according to claim 1 further comprising one or more laundry adjunct materials selected from the group consisting of stabilizers; coupling agents; fabric substantive perfumes; fabric softeners; chelating agents; effervescent systems; cationic surfactants; nonionic surfactants; and mixtures thereof.

5. A liquid laundry detergent composition according to claim 1 wherein the coacervate phase forming cationic polymer is selected from cationic cellulose and derivatives thereof, cationic starch and derivatives thereof, and mixtures thereof.

6. A liquid laundry detergent composition according to claim 1 wherein the coacervate phase forming cationic polymer is selected from cationic polysaccharide polymers of the formula:

$$A—O—[R—N^{+}(R^{1})(R^{2})(R^{3})]X^{-}$$

wherein A is an anhydroglucose residual group, R is an alkylene, oxyalkylene, polyoxyalkylene, or hydroxyalkylene group, or combination thereof, and $R^1$, $R^2$, and $R^3$ independently are selected from alkyl, aryl, alkylaryl, arylalkyl, alkoxyalkyl, or alkoxyaryl, each group comprising up to 18 carbon atoms, and X is an anionic couterion.

7. A liquid laundry detergent composition according to claim 6 wherein the cationic polysaccharide polymer has a total number of carbon atoms for each cationic moiety of 20 or less.

8. A liquid laundry detergent composition according to claim 5 wherein the coacervate phase forming cationic polymer is a cationic cellulose.

9. A liquid laundry detergent composition according to claim 8 wherein the cationic cellulose is a salt of hydroxyethyl cellulose reacted with trimethyl ammonium substituted epoxide.

10. A liquid laundry detergent composition according to claim 8 wherein the cationic cellulose is a polymeric quaternary ammonium salt of hydroxyethyl cellulose reacted with lauryl dimethyl ammonium-substituted epoxide.

11. A liquid laundry detergent composition according to claim 1 wherein the coacervate phase forming cationic polymer is a cationic polysaccharide polymer selected from quaternary nitrogen-containing cellulose ethers, copolymers of etherified cellulose and starch, and combinations thereof.

12. A liquid laundry detergent composition according to claim 1 wherein the enzyme is a detersive enzyme selected from protease, amylase, cellulase, mannanase, endoglucanase, lipase and mixtures thereof.

13. A liquid laundry detergent composition according to claim 12 wherein the composition comprises from 0.0001% to 5%, by weight of the composition, of the enzyme.

14. A liquid laundry detergent composition according to claim 1 wherein the composition further comprises a soil release polymer.

15. A liquid laundry detergent composition according to claim 8 wherein the composition further comprises a soil release polymer.

16. A method for providing fabric softening benefits, anti-abrasion benefits, anti-pilling benefits or any combination thereof to fabrics, which method comprises treating the fabrics with the liquid laundry detergent composition according to claim 1.

* * * * *